United States Patent [19]

Hara et al.

[11] Patent Number: 4,988,492

[45] Date of Patent: Jan. 29, 1991

[54] METHOD FOR INFUSIBILIZING PITCH FIBERS

[75] Inventors: Yojiro Hara; Shinzo Ishikawa; Hiroaki Shono, all of Fukushima; Taiji Matsumoto, Chiba, all of Japan

[73] Assignees: Nitto Boseki Co., Ltd., Fukushima; Kawasaki Steel Corporation, Kobe, both of Japan

[21] Appl. No.: 497,774

[22] Filed: Mar. 21, 1990

Related U.S. Application Data

[63] Continuation of Ser. No. 247,513, Sep. 22, 1988, abandoned.

[30] Foreign Application Priority Data

Sep. 28, 1987 [JP] Japan ..... 62-240986
Aug. 29, 1988 [JP] Japan ..... 63-214569

[51] Int. Cl.[5] ..... D01F 9/12

[52] U.S. Cl. ..... 423/447.4; 423/447.1; 423/447.2; 423/447.6; 264/29.2

[58] Field of Search ..... 423/447.1, 447.2, 447.4, 423/447.6; 264/29.2; 422/109

[56] References Cited

U.S. PATENT DOCUMENTS

| | | | |
|---|---|---|---|
| 2,154,746 | 4/1939 | Heid | 204/34 |
| 3,664,900 | 5/1972 | Cuckson et al. | 423/447.1 |
| 4,020,273 | 4/1977 | Dix et al. | 422/109 |
| 4,195,061 | 3/1980 | Kalasek | 422/109 |
| 4,265,869 | 5/1981 | Kaji et al. | 423/447.2 |
| 4,314,981 | 2/1982 | Miyamori et al. | 264/29.2 |
| 4,351,816 | 9/1982 | Schulz | 264/29.2 |
| 4,389,387 | 6/1983 | Miyamori et al. | 264/29.2 |
| 4,461,159 | 7/1984 | Prescott | 423/447.6 |
| 4,552,743 | 11/1985 | Torigata et al. | 264/29.2 |
| 4,574,077 | 3/1986 | Uemura et al. | 423/447.2 |
| 4,576,810 | 3/1986 | Redick | 423/447.1 |

FOREIGN PATENT DOCUMENTS

| | | | |
|---|---|---|---|
| 1182957 | 2/1985 | Canada | 264/29.2 |
| 100411 | 2/1984 | European Pat. Off. | 423/447.1 |
| 47-21903 | 6/1972 | Japan | 423/447.1 |
| 47-21904 | 6/1972 | Japan | 423/447.1 |
| 49-125665 | 12/1974 | Japan | 423/447.1 |
| 51-60774 | 5/1976 | Japan | 423/447.1 |
| 55-6547 | 1/1980 | Japan | 423/447.1 |
| 55-90621 | 12/1980 | Japan | 423/447.1 |
| 58-60019 | 10/1981 | Japan | 423/447.1 |
| 58-53085 | 11/1983 | Japan | 423/447.1 |
| 60-167928 | 2/1984 | Japan | 423/447.1 |
| 59-12917 | 6/1984 | Japan | 423/447.1 |
| 59-192723 | 11/1984 | Japan | 264/29.2 |
| 60-126323 | 7/1985 | Japan | 423/447.1 |
| 60-151316 | 8/1985 | Japan | 423/447.1 |
| 60-173121 | 9/1985 | Japan | 264/29.2 |
| 61-282429 | 12/1986 | Japan | 423/447.1 |
| 1018705 | 5/1983 | U.S.S.R. | 422/109 |

OTHER PUBLICATIONS

Hawthorne et al., "High Strength High Modulus Graphite Fibres From Pitch", Nature, vol. 223, Aug. 29, 1970, pp. 946–947.

Patent Abstracts of Japan, vol. 9, No. 134 (C-285) [1857], Jun. 8, 1985.

*Primary Examiner*—Olik Chaudhuri
*Assistant Examiner*—Robert M. Kunemund
*Attorney, Agent, or Firm*—Wegner, Cantor, Mueller & Player

[57] ABSTRACT

This invention provides a method for infusibilization of pitch fibers for production of carbon fibers which comprises putting pitch fibers prepared by melt spinning from a spinning pitch in containers, introducing in succession the containers containing the pitch fibers into an infusibilizing furnace divided into a plurality of sections and passing the containers therethrough from inlet to outlet wherein the containers containing the pitch fibers are intermittently moved through the infusiblizing furnace to retain each of the containers in respective sections for a given period of time, during which temperature of respective sections is independently raised from minimum controlled temperature to maximum controlled temperature and thereafter is lowered to the minimum controlled temperature and then the container is moved.

5 Claims, 5 Drawing Sheets

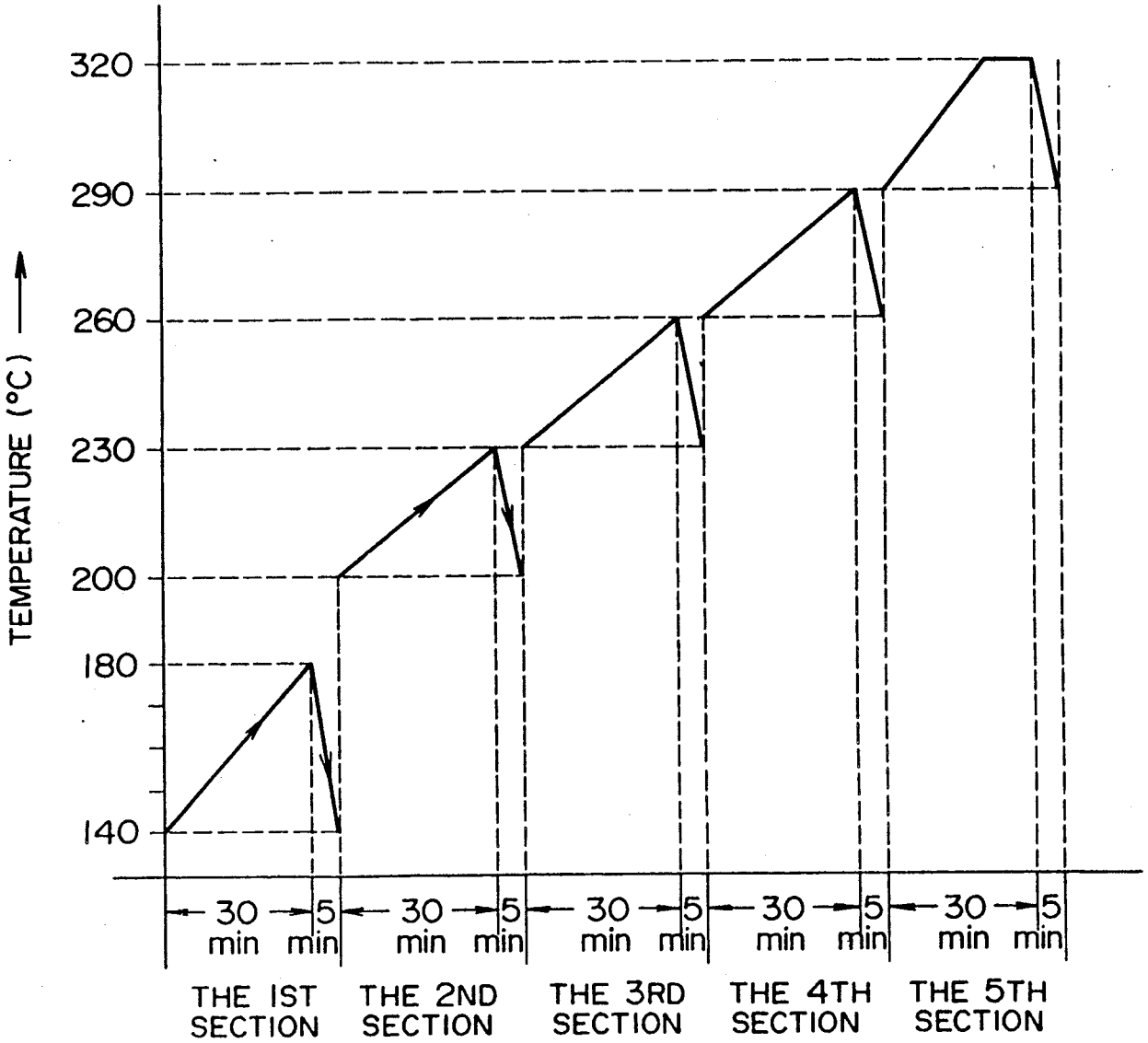
FIG. 2-(a)

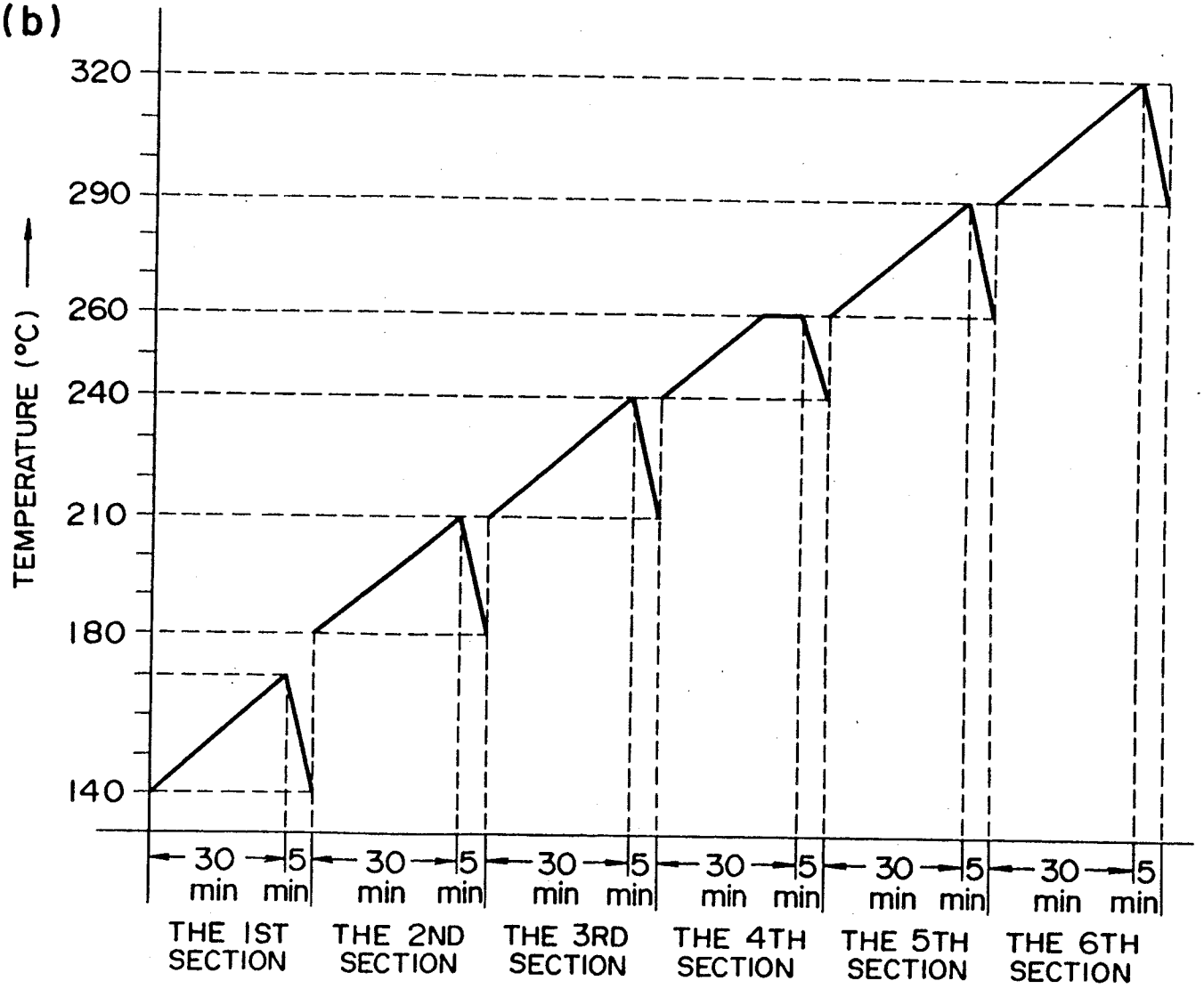
FIG. 2-(b)

METHOD FOR INFUSIBILIZING PITCH FIBERS

This application is a continuation of U.S. application Ser. No. 07/247,513 filed Sept. 22, 1988, now abandoned.

BACKGROUND OF THE INVENTION

This invention relates to a method for infusibilization of pitch fibers by heat treating, in an oxidizing atmosphere, pitch fibers obtained by melt spinning a spinning pitch prepared from coal or petroleum pitch.

In the case of producing carbon fibers by melt spinning a coal or petroleum pitch, pitch fibers prepared by spinning a pitch are heat meltable and, if the pitch fibers are carbonized as they are, they are molten and cannot retain the individual fibrous shape. Therefore, infusibilization treatment of pitch fibers to insolubilize and infusibilize the pitch fibers by introduction of oxygen into molecular structure of pitch in the pitch fibers to produce crosslinkage therein is conducted under controlled conditions before carbonization treatment.

For infusibilization of pitch fibers, there have been proposed a method of dipping pitch fibers in an aqueous solution of an oxidizing agent (Japanese Patent Kokoku (Post Exam Publn) Nos. 47-21904 and 47-21905) and a method of extracting a component of low softening point in pitch fibers with a solvent (Japanese Patent Kokoku (Post Exam Publn) No. 52-38855 and Japanese Patent Kokai (Laid Open Publn) No. 61-2824). Normally, however, there has been employed a method of infusibilization by heating pitch fibers in an oxidizing gas (such as air, oxygen, ozone, nitrogen dioxide or mixed gas thereof) to oxidize the fibers.

For heating pitch fibers in an oxidizing gas, the following methods have been proposed, namely, a method of putting pitch fibers in a container and infusibilizing the fibers in batchwise manner (Japanese Patent Kokai (Laid Open Publn) Nos. 60-151316 and 61-12917), a method of continuously introducing pitch fibers accumulated on a conveyor into an infusibilizing furnace and continuously infusibilize the fibers therein (Japanese Patent Kokai (Laid Open Publn) Nos. 51-60774, 55-90621 and 59-192723), a method of continuous infusibilization by putting pitch fibers in a container or suspending them in a container and introducing continuously or intermittently this container into an infusibilizing furnace (Japanese Patent Kokai (Laid Open Publn) Nos. 55-6547, 58-60019 and 60-126323).

According to the batchtype infusibilizing method, temperature of the infusibilizing furnace can be accurately controlled depending on the rising rate of softening temperature of pitch fibers with progress of infusibilization and generation of heat from pitch fibers with progress of infusibilization and thus infusibilization can be performed without damaging the characteristics of fibers and causing runaway reaction of pitch fibers. However, it is well known that heat treatment of batch process system is industrially disadvantageous and is not suitable for mass-production of carbon fibers. Infusibilization of pitch fibers by accumulating pitch fibers on a conveyor or in a container and continuously passing the pitch fibers through an infusibilizing furnace can be expected to accomplish higher productivity than the batchtype infusibilization. However, control of distribution of temperature in the furnace is difficult and so it is difficult to perform heat treatment of pitch fibers at proper heating rate. That is, in the case of a furnace of conveyor type, normally inside of the furnace is divided into a plurality of sections, in each of which are provided a ventilating apparatus and a temperature controlling apparatus and heat treatment is carried out by blowing an oxidizing gas adjusted to a given temperature upon pitch fibers or flowing the oxidizing gas through the pitch fibers. According to such furnace, naturally, the middle part of each section in lengthwise derection has relatively uniform and flat distribution of temperature while abrupt change of temperature and thus non-uniform distribution of temperature occur at boundary part of each section. Therefore, when conveyor or container is moved at a constant speed through the infusibilizing furnace, the pitch fibers on the conveyor or in the container undergo extremely non-uniform and stepwise change of temperature (heating rate). That is, heating rate is slow and thus infusibilization reaction is gentle in the middle part of each section. On the other hand, elevation of temperature is rapid and infusibilization reaction is abrupt in the boundary part of each section. Rapid elevation of infusibilization temperature causes the temperature of atmosphere to be close to softening point of pitch fibers and causes fusion bonding of fibers. Thus, not only characteristics of fibers are damaged, but also uncontrollable exothermic reaction is brought about depending on state of accumulation of fibers and state of ventilation. Therefore, operating conditions of infusibilizing furnace of such type (preset temperature in each section, speed of conveyor, ventilation condition and accumulation amount of pitch fibers) are limited on the basis of heating rate in boundary part between each section and thus, there must be employed such conditions which result in reduction of productivity, for example, reduction in conveyor speed and decrease in accumulated amount of pitch fibers.

The method of infusibilization by intermittently introducing containers in which pitch fibers are accumulated, into infusibilizing furnace or intermittently moving the containers through the furnace also suffers from the problem of temperature control.

That is, in the method of intermittently moving the container, pitch fibers undergo more stepwise change of heat treating temperature than in the continuous moving method, namely, they are repeatedly subjected to retention of a certain temperature and abrupt elevation of temperature. According to such heating method, infusibilizing reaction comprises combination of rapid and slow progresses and operating conditions of infusibilizing furnace are limited on the basis of rapid heating rate just after beginning of movement as mentioned for the method of continuous introduction of conveyor or container into infusibilizing furnace. For this reason, measures such as increase of residence time in each section and decrease of the amount of accumulation of pitch fibers on conveyors or in containers must be taken, which inevitably reduce productivity.

As explained above, the conventional infusibilizing methods all have defects. Especially, it is a essential problem in production of pitch-based carbon fibers that elevation of heat treating temperature of pitch fibers is not uniform and so the productivity is restricted in the industrially important method of continuous or semi-continuous infusibilization by continuously or intermittently introducing conveyors or containers into an infusibilizing furnace.

SUMMARY OF THE INVENTION

In order to solve the problem of reduction in productivity due to ununiformity of heating rate as mentioned above and as a result, it has been found that heating rate of heat treatment which pitch fibers undergo in an infusibilizing furnace can be freely changed by employing a specific method. This invention is based on this finding.

BRIEF EXPLANATION OF THE DRAWINGS

FIG. 2-(*a*) shows a temperature rising curve in another embodiment of this invention and FIG. 2-(*b*) shows a temperature rising curve in another embodiment of FIG. 2-(*a*).

DETAILED DESCRIPTION OF THE INVENTION

Figure 1:
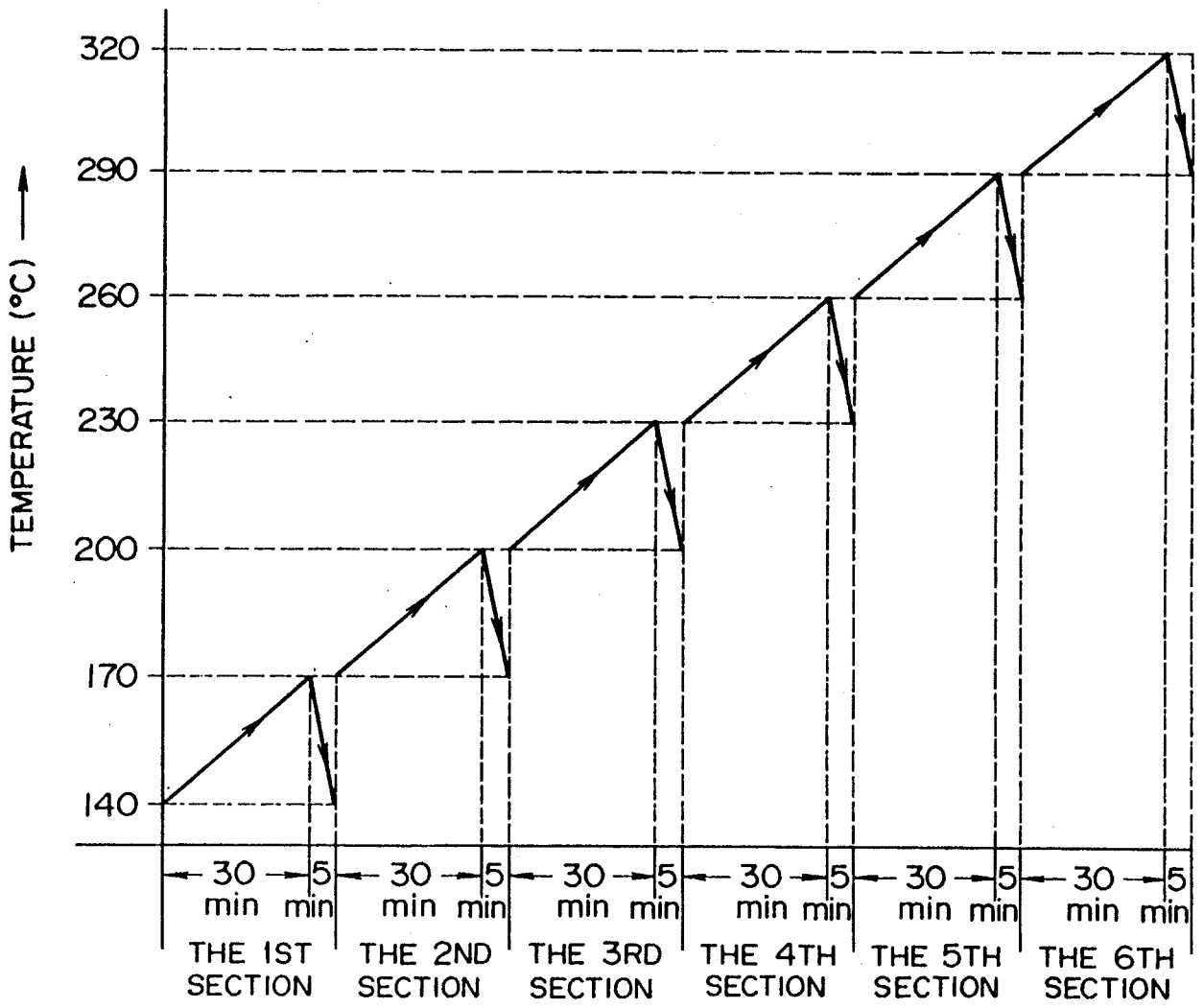
FIG. 1 shows a temperature rising curve in respective sections in the infusibilizing furnace in Example 1.

According to this invention, by satisfying the following conditions, smooth heating rate close to that obtained in infusibilization of batch type can be obtained in infusibilization of semicontinuous type and thus reduction of productivity due to non-uniform heating rate can be prevented.

In practice of this invention, an infusibilizing furnace divided in a plurality of sections in longitudinal direction is used and containers containing pitch fibers are intermittently introduced into this infusibilizing furnace and passed in succession therethrough from inlet to outlet to perform infusibilization.

It is necessary that respective sections in the infusibilizing furnace are divided so that they are thermally independent from each other and that respective sections have a hot air circulating device, a heating device and temperature controlling device so as to be able to independently control the temperature. By employing such means, temperature control in respective sections can be performed independently and accurately without being influenced by adjacent sections.

Next, it is necessary that movement or travelling of the containers containing pitch fibers in the infusibilizing furnace is intermittent and that one container moves from one section to another section by one movement. In such a type that a container containing pitch fibers moves continuously and little by little, it is difficult to maintain thermal independency of the respective divided sections and furthermore, movement of the containers must be intermittent because the residence time of the container in one section is considered one unit of infusibilization treatment in this invention. For the same reason, it is necessary that one container moves to the next section by one movement.

By such movement, respective containers are retained in respective sections for a certain time.

As explained above, in this invention, a container containing pitch fibers moves to the subsequent section in succession with being retained for a certain time in respective sections and thus infusibilization of pitch fibers is allowed to proceed.

In this case, it is necessary that the controlled temperature in respective sections are not always kept at constant, but are properly changed with movement of the container and lapse of residence time. In more detail, controlled temperature in a section becomes the minimum controlled temperature in this section just after movement of the container into the section, thereafter is gradually raised with lapse of time to reach the maximum controlled temperature in this section and then is lowered after keeping that temperature for a required time, if necessary, to reach the minimum temperature again at the expiration of the residence time. In this pattern the controlled temperature is changed. In order to change the temperature in respective sections in such pattern, it is necessary that respective sections are thermally independent as mentioned before and that the temperature controlling apparatuses in respective sections are so-called program-control type which can change control temperature depending on lapsed time.

If such change of controlled temperature is not effected, but the temperature in respective section is controlled to a constant temperature, as referred to in explanation of conventional art, temperature of heat treatment which pitch fibers undergo abruptly rises just after the intermittent movement and there are possibilities of fusion bonding of softened fibers and of run-away reaction due to rapid progress of infusibilizing section.

The pattern of temperature for infusibilization according to this invention is basically set as follows. First, average temperature in respective sections is set so that it is lowest in the section of inlet side and highest in the section of outlet side as is known in the art. Next, the time required for the one cycle of low → high → low of temperature in respective sections is set so as to be equals to or shorter than the residence time in respective section. In such one cycle of temperature change, infusibilization of higher efficiency can be performed by taking a longer time for temperature raising part of low → high and taking a time of as short as possible for cooling part of high → low.

With reference to setting of temperature in respective sections, the minimum controlled temperature in a section is set to be nearly equal to the maximum controlled temperature in the previous section and the maximum controlled temperature in a section is set to be nearly equal to the minimum controlled temperature in the next section. In another embodiment, minimum controlled temperature is set to be higher than the minimum controlled temperature in the previous section and maximum controlled temperature is set to be higher than the maximum controlled temperature in the previous section. Minimum temperature in the first section in which heat treatment of pitch fibers is effected is set at about temperature where infusibilization reaction starts (normally 120–200° C.) and maximum temperature in the last section where heat treatment is effected is set at the maximum temperature of infusibilization treatment (normally 280–400° C).

The rising rate of temperature in each section is set to be between 0.3–10° C./min depending on the conditions in respective stages in infusibilizing process.

The number of sections in the infusibilizing furnace is at least 2 and normally is 4–16 although optimum number of sections can be determined considering the conditions such as production efficiency, economy, production quantity and quality of products.

In the case of carrying out the infusibilizing treatment under the above-mentioned conditions, pitch fibers are infusibilized by moderate rising of temperature and thereafter once cooled in a section and moved to the next section. Just after beginning of movement, i.e., entering into a section, pitch fibers are subjected to relatively rapid rising of temperature, but this temperature rise has substantially no part in infusibilization reaction. This is because the rising of temperature here means a repetition of the heat treatment by the moderate temperature rising in the previous section and infusibilization reaction in this temperature range has already been terminated in the previous section.

Figure 4:
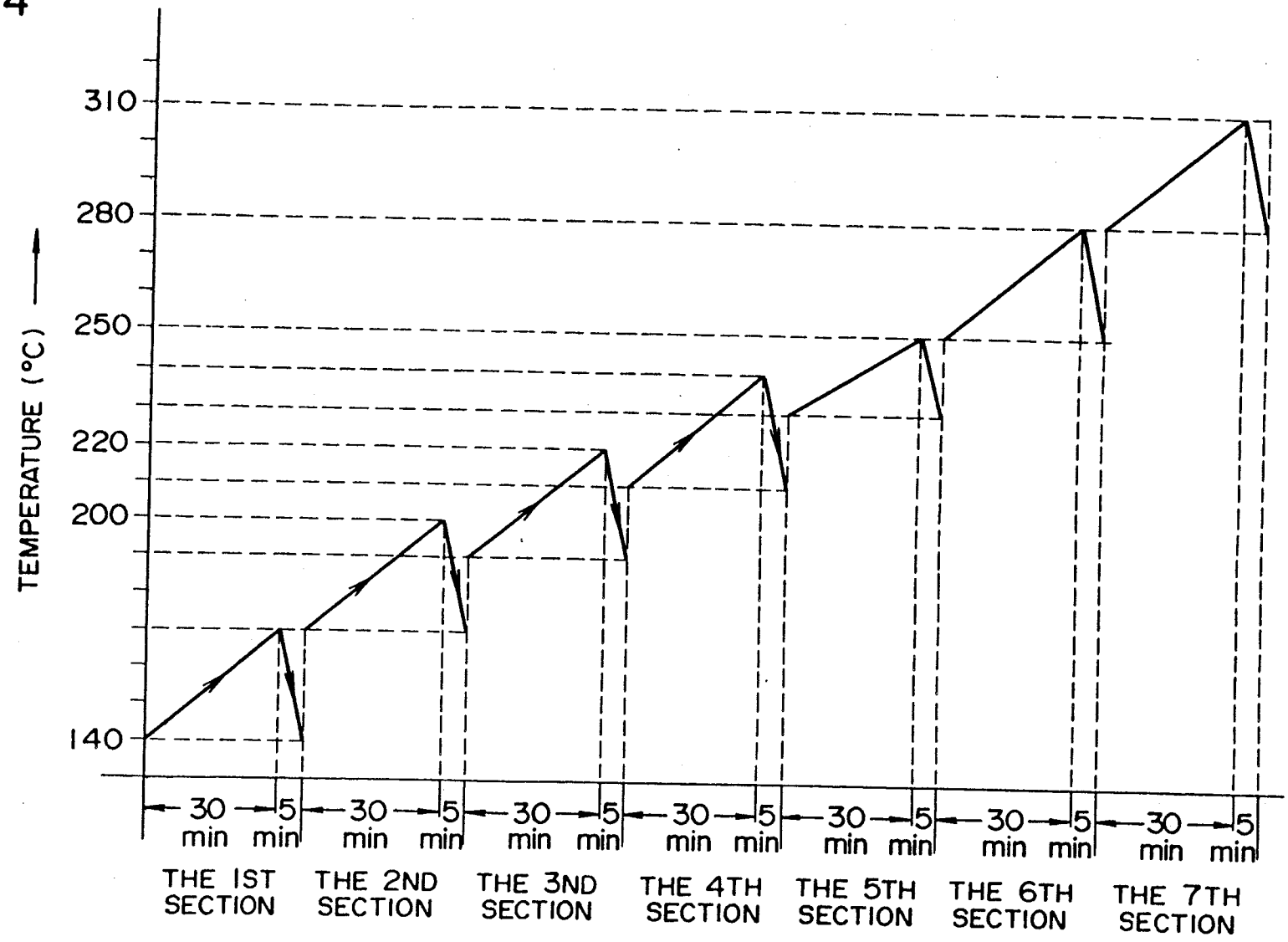
FIG. 4 shows a temperature rising curve in respective sections in Example 3.

After termination of the rapid temperature rising just after movement of pitch fibers, infusibilization is effected again by moderate temperature rising. This infusibilization begins at a temperature substantially equal to the maximum temperature in the previous section and terminates at a temperature substantially equal to the minimum temperature in the next section. Pitch fibers undergo such heat treatment at respective intermittent movements and thus, considering the overall infusibilization, although this is semicontinuous type treatment, pitch fibers can be subjected to infusibilization treatment by moderate temperature rising as if this is a batch type treatment. However, it is not always necessary to limit the method of setting the temperatures in all sections to such type and it may be changed depending on amount of pitch fibers charged in stainless steel tray for firing of pitch fibers and state of ventilation in the pitch fiber layer. In a temperature range in which it is difficult to generate rapid oxidizing reaction of fibers and fusion bonding and ignition of fibers, it is possible to shorten the infusibilizing time by setting minimum controlled temperature in a section at higher than the maximum controlled temperature in the previous section (FIGS. 2-(*a*) and -(*b*), the second section), or it is possible to inhibit rapid oxidizing reaction of fibers and to more completely prevent fusion bonding and ignition of fibers by setting minimum controlled temperature in a section at lower than the maximum controlled temperature in the previous section to provide a portion of temperature where the controlled temperature overlaps the controlled temperature in the previous section (FIG. 4, the third section, the fourth section and the fifth section) or by decreasing the rate of temperature rise (FIG. 4, the fifth section). Furthermore, it is also possible to provide a section where a raised temperature is kept at constant to prevent uneven heat treatment (FIG. 2-(*a*), the fifth section and FIG. 2-(*b*), the fourth section).

The effects of the invention will be explained by the following examples.

EXAMPLE 1 AND COMPARATIVE EXAMPLE 1

Figure 3:
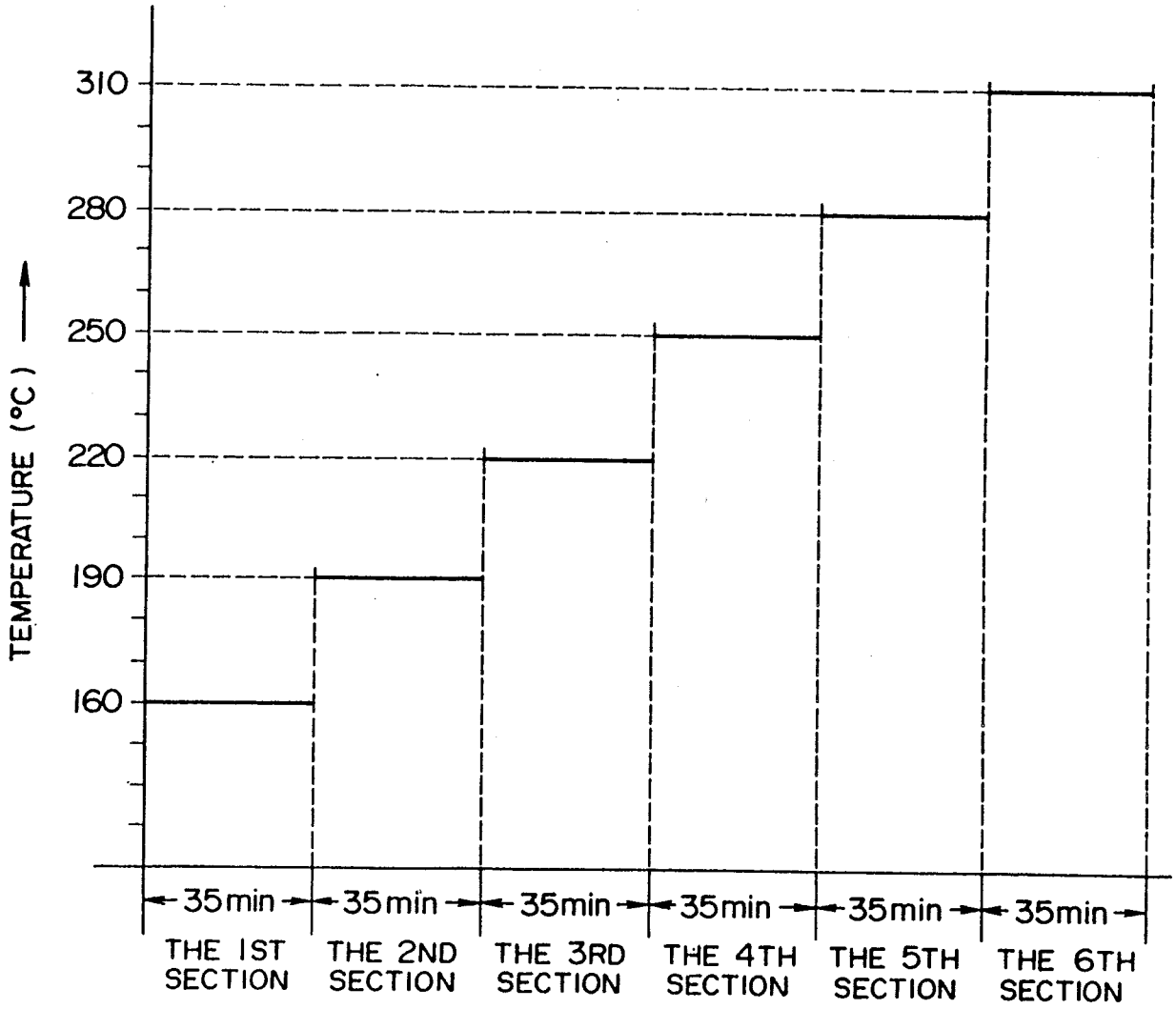
FIG. 3 shows a temperature rising curve in Comparative Example 1.

A coal tar pitch as a raw material was subjected to filtration to remove insoluble solid matter and then to heat treatment under reduced pressure to remove low boiling point components to obtain a spinning pitch of 58% in benzene insolubles, 0% in quinoline insolubles, and 220° C. in softening point (hot plate method) and containing substantially no optically anisotropic component. Fibers were spun from this pitch by a centrifugal spinning machine with nozzle having 512 holes at 300° C. to obtain wool-like pitch fibers having an average fiber diameter of 13 microns. The resulting wool-like pitch fibers were put in a stainless steel container of 60 cm × 60 cm × 20 cm depth with a bottom made of a net of 20 meshes in an amount of 360 g (bulk density 0.01 g/cm$^3$) at a height of 10 cm. The containers were put on a stand plate and were successively introduced into an infusibilizing furnace divided into 6 chambers at an interval of 35 minutes to perform infusibilization of semicontinuous type. Temperature distribution in the furnace was as shown in the following Table 1 and temperature rise curve is shown in FIG. 1 and FIG. 3. The atmospheric gas was air.

TABLE 1

| | Example 1 | Comparative Example 1 |
|---|---|---|
| The 1st section | 140° C. → 170° C. → 140° C. | 160° C. |
| The 2nd section | 170° C. → 200° C. → 170° C. | 190° C. |
| The 3rd section | 200° C. → 230° C. → 200° C. | 220° C. |
| The 4th section | 230° C. → 260° C. → 230° C. | 250° C. |
| The 5th section | 260° C. → 290° C. → 260° C. | 280° C. |
| The 6th section | 290° C. → 320° C. → 290° C. | 310° C. |

In the case of Example 1, 30 minutes was required for raising the temperature from minimum temperature to maximum temperature and 5 minutes was required for cooling from the maximum temperature to the minimum temperature in respective sections. In Comparative Example 1, temperature was controlled to a constant temperature in each respective section.

When infusibilization was performed under the above conditions, infusibilization was able to be completed without problems in Example 1. After infusibilization, bulk of the pitch fibers was reduced to 6 cm in height. When infusibilization was performed according to the method of Comparative Example 1, uncontrollable exothermic reaction took place when the first container moved to the 4th section, resulting in ignition and so infusibilization was discontinued.

EXAMPLE 2 AND COMPARATIVE EXAMPLE 2

Coal tar pitch as a raw material was hydrogenated in tetralin in an amount of twice that of the pitch in an autoclave, then subjected to filtration and distillation to remove insoluble matters and the solvent and further to heat treatment to obtain an optically anisotropic spinning pitch. This pitch contained 97% of optically anisotropic part, 91% of benzene insolubles and 32% of quinoline insolubles and had a softening point of 275° C. (hot plate method). This pitch was introduced into an extrusion type melt spinning machine having a nozzle plate of 400 holes and fibers were spun from this pitch at a spinning temperature of 345° C. and a take-up speed of 600 m/min to obtain pitch fibers having an average fiber diameter of 12 microns. The resulting fibers were applied with 3% of silicone oil containing less than 10% of nonvolatile matter (at 180° C.) to gather the filaments into the fiber bundle. The pitch fibers were dropped from bobbins with unwinding and accumulated in an amount of about 100 g in each of the same stainless steel trays as used in Example 1. These trays were introduced into the infusibilizing furnace to perform infusibilization in the same manner as in Example 1. Temperature distribution in the infusibilizing furnace was the same as in Example 1 and Comparative Example 1, but residence time in one section was 25 minutes. Time required for temperature raising in each section was 20 minutes and that for cooling was 5 minutes. Infusibilization was carried out in the manner where temperature was changed during residence time in respective sections according to this invention and in the manner where temperature was kept constant in respective sections for comparison (Comparative Example 2). In both the cases, infusibilization was completed without uncontrollable exothermic reaction. Thus infusibilized fibers were carbonized by heating to 1100° C. in a nitrogen gas. Strength of the carbonized fiber samples was measured by single fiber method (JIS-R-7601). No fusion bonding occurred for carbon fibers made from pitch fibers infusibilized by the method of Example 2 and average strength of 20 samples was 225 kg/mm$^2$. A slight fusion bonding occurred for carbon fibers made from pitch fibers infusibilized by the method of Comparative Example 2 and average strength of 20 samples was 182 kg/mm$^2$.

EXAMPLE 3 AND COMPARATIVE EXAMPLE 3

Pitch filaments of 13 μm in diameter were spun through 1000 hole nozzle from a spinning mesophase pitch having a quinoline insolubles of 35% by weight. These filaments were combined into a bundle with a 10% by weight molybdenum disulfide dispersion and then the bundle was cut by a continuous cutting device to obtain a pitch fiber chopped strand of 6 mm in length. 850 grams of the chopped strands (bulk density: 0.3 g/cm$^3$) were put in the same containers as used in Example 1 and levelled therein. These were introduced into an infusibilizing furnace divided into 7 sections at an interval of 35 minutes in succession and infusibilized therein. Control of temperature in respective sections of the furnace was carried out as shown in Table 2 and temperature rising curve is shown in FIG. 4. Temperatures in respective section in Comparative Example 3 are also shown in Table 2. Air was used as atmospheric gas.

TABLE 2

| | Example 3 | Comparative Example 3 |
|---|---|---|
| The 1st section | 140° C. → 170° C. → 140° C. | 160° C. |
| The 2nd section | 170° C. → 200° C. → 170° C. | 190° C. |
| The 3rd section | 190° C. → 220° C. → 190° C. | 210° C. |
| The 4th section | 210° C. → 240° C. → 210° C. | 230° C. |
| The 5th section | 230° C. → 250° C. → 230° C. | 250° C. |
| The 6th section | 250° C. → 280° C. → 250° C. | 280° C. |
| The 7th section | 280° C. → 310° C. → 280° C. | 310° C. |

The chopped strands obtained in Example 3 underwent less partial rising of temperature in the chopped strand layer since they were subjected to uniform heat treatment in the infusibilizing containers. Therefore, the resulting chopped strands showed no fusion bonding and were completely dispersed into filaments when they were dispersed in an aqueous solution of nonionic surface active agent with agitation.

For Comparative Example 3, the pitch fiber chopped strands placed in stainless container in the same manner as in Example 3 were infusibilized by introducing the infusibilizing furnace controlled in temperature as shown in Table 2. The resulting chopped strands were fusion bonded in part due to partial rising of temperature owing to overheating. When these chopped strands were dispersed in an aqueous solution of nonionic surface active agent with agitation, they were not completely dispersed into filaments and about 15% of them remained in the form of agglomerate or fiber bundle.

The method of infusibilization of pitch fibers according to this invention has the following advantages as compared with the conventional methods using continuous or intermittent introduction type infusibilizing furnace.

(1) Since pitch fibers are infusibilized by substantially continuous elevation of heat treating temperature, there is no abrupt elevation of temperature as compared with the conventional methods according to which temperature changes stepwise. As a result, ignition due to uncontrollable exothermic reaction and fusion bonding of fibers can be prevented.

(2) Atmospheric temperature can be elevated so as to obtain reaction temperature corresponding to softening temperature of pitch fibers which rises depending on stages of infusibilization.

(3) Heat generated by partial overheating is dispersed at cooling step and formation of hot spots (red hot spots) and fusion bonding of fibers due to heat can be prevented.

What is claimed is:

1. A method for infusibilization of pitch fibers for production of carbon fibers which comprises putting pitch fibers prepared by melt spinning from a spinning pitch in containers, introducing in succession the containers containing the pitch fibers into an infuxibilizing furnace divided into a plurality of sections and passing the containers therethrough from inlet to outlet wherein the containers containing the pitch fibers are intermittently moved through the infusibilizing furnace to retain each of the containers in respective sections for a given period of time, during which temperature in each of the respective sections is independently raised form a minimum controlled temperature to a maximum controlled temperature and thereafter is lowered to the minimum controlled temperature, wherein the difference between the maximum controlled temperature and the minimum controlled temperature in each of the respective sections is set to be a temperature not less than 5° C. and the rising and the lowering of the temperature occurs once per section, and then the container is moved.

2. A method according to claim 1 wherein the minimum controlled temperature and the maximum controlled temperature in second and the subsequent respective sections is set to be higher than the corresponding temperatures in the previous section, and the minimum temperature in the first section is 120–200° C. and the maximum temperature in the last section is 280–400° C.

3. A method according to claim 1 wherein the minimum controlled temperature in a section is set to be nearly equal to the maximum controlled temperature int eh previous section and the maximum controlled temperature is set to be nearly equal to the minimum controlled temperature in the next section, and the maximum controlled temperature and the minimum controlled temperature are set to be not more than a softening point of the pitch fibers.

4. A method according to claim 1 wherein rate of temperature rise in the respective section is 0.3–10° C./min, and lowering rate of temperature in the respective section is not more than 28° C./min.

5. A method according to claim 1 wherein the number of sections in the fusibilizing furnace is 4–16.

* * * * *